US006813831B2

(12) United States Patent
Kamei et al.

(10) Patent No.: US 6,813,831 B2
(45) Date of Patent: Nov. 9, 2004

(54) LIQUID JETTING HEAD, METHOD OF MANUFACTURING THE SAME, AND LIQUID JETTING APPARATUS INCORPORATING THE SAME

(75) Inventors: Hiroyuki Kamei, Nagano (JP); Masami Murai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/827,470

(22) Filed: Apr. 20, 2004

(65) Prior Publication Data

US 2004/0196336 A1 Oct. 7, 2004

Related U.S. Application Data

(62) Division of application No. 10/242,665, filed on Sep. 13, 2002, now Pat. No. 6,758,554.

(30) Foreign Application Priority Data

Sep. 13, 2001 (JP) ..... P2001-278115

(51) Int. Cl.[7] ..... B21D 53/76; B41J 2/045; H04R 17/00

(52) U.S. Cl. ..... 29/890.1; 29/25.35; 347/70

(58) Field of Search ..... 29/890.1, 890.09, 29/25.35, 729; 347/70, 68, 71, 44, 45, 46, 47

(56) References Cited

U.S. PATENT DOCUMENTS

| | | | | |
|---|---|---|---|---|
| 6,616,270 | B1 | 9/2003 | Miyata et al. | |
| 2003/0058310 | A1 * | 3/2003 | Murai | 347/71 |
| 2003/0081080 | A1 | 5/2003 | Moriya et al. | |
| 2003/0206218 | A1 | 11/2003 | Miyata et al. | |

FOREIGN PATENT DOCUMENTS

| | | | |
|---|---|---|---|
| JP | 6-316073 | 11/1994 | |
| JP | 2000-103059 | * 4/2000 | B41J/2/045 |

* cited by examiner

*Primary Examiner*—Manish Shah
(74) *Attorney, Agent, or Firm*—Sughrue Mion, PLLC

(57) ABSTRACT

A first substrate defines a plurality of pressure generating chambers. The first substrate includes a vibration plate which forms a first surface of the first substrate, and formed with a first through hole. A plurality of piezoelectric elements are provided on the vibration plate. A second substrate is bonded onto at least the first surface of the first substrate. The second substrate is formed with a second through hole communicated with the first through hole. A laminated film includes a coating layer comprised of a resin material. The laminated film is provided on an inner wall face of a communicating portion at which the first through hole and the second through hole are connected.

9 Claims, 9 Drawing Sheets

LIQUID JETTING HEAD, METHOD OF MANUFACTURING THE SAME, AND LIQUID JETTING APPARATUS INCORPORATING THE SAME

This is a divisional of application Ser. No. 10/242,665 filed Sep. 13, 2002 now U.S. Pat. No. 6,758,554; the disclosure of which is incorporated herein by reference.

BACKGROUND OF THE INVENTION

The present invention relates to a liquid jetting head, a method of manufacturing the same, and a liquid jetting apparatus such as a recording head for an ink jet recording apparatus, an electrode member ejection head for an electrode forming apparatus, an organic substance jetting head for a bio-chip manufacturing apparatus, or the like, in which liquid is ejected by deformation of piezoelectric elements formed on a surface of a diaphragm formed as a part of pressure generating chambers communicating with nozzle orifices from which liquid is ejected.

For example, a serial printing type ink jet recording apparatus, which is one kind of the liquid jetting apparatus, including either one of two types of liquid jetting heads (hereinafter, referred as "ink jet recording heads") have been put into practical use as the ink jet recording head in which a diaphragm formed as a part of pressure generating chambers communicating with nozzle orifices is deformed by piezoelectric elements to pressurize liquid (hereinafter, referred as "ink") in the pressure generating chambers to thereby eject ink drops from the nozzle orifices. One type of ink recording head uses a longitudinal vibration mode piezoelectric actuator that expands and contracts in an axial direction of the piezoelectric elements. The other type of ink recording head uses a flexure vibration mode piezoelectric actuator.

The former has an advantage in that a head adapted to high-density printing can be manufactured because the volume of the pressure generating chambers can be changed by the diaphragm abutting on end surfaces of the piezoelectric elements. In the former, there are, however, required the process of cutting a piezoelectric element into the form of the teeth of a comb in accordance with the pitch of arrangement of the nozzle orifices, and the work of positioning the thus cut piezoelectric elements to be fixed to the pressure generating chambers respectively.

On the other hand, the latter has an advantage in that the piezoelectric elements can be built in the diaphragm by a relatively simple process in which a green sheet of piezoelectric material is put in accordance with the shape of the pressure generating chambers and then baked.

In such an ink jet recording head, a reservoir is generally formed as an ink chamber common to all the pressure generating chambers, so that ink is supplied to the respective pressure generating chambers through the reservoir.

In such an ink jet recording head, there is, however, the possibility that an inner surface constituting the reservoir may crack because the reservoir is provided with a partially mechanically ruptured portion. If such a reservoir filled with ink is used, a cracked portion of the inner surface of the reservoir may peel off as a broken piece. Hence, there is a problem that failure in ejection occurs because some nozzle orifice is choked with the broken piece.

In addition, a positioning hole or the like used for joining respective substrates is provided with a partially mechanically ruptured portion in the same manner as the reservoir. Hence, there is probability that failure in ejection may occur because of an alien substance such as a broken piece generated in the positioning hole.

SUMMARY OF THE INVENTION

It is therefore an object of the invention to provide a liquid jetting head, a method of manufacturing the same, and a liquid jetting apparatus incorporating the same, in which failure in ejection is prevented from being caused by an alien substance.

In order to achieve the above object, according to the present invention, there is provided a liquid jetting head, comprising:

- a first substrate, which defines a plurality of pressure generating chambers, the first substrate including a vibration plate which forms a first surface of the first substrate, and formed with a first through hole;
- a plurality of piezoelectric elements, each provided on the vibration plate so as to associate with one of the pressure generating chambers, each piezoelectric element comprised of an upper electrode, a lower electrode and a piezoelectric layer provided between the upper electrode and the lower electrode;
- a second substrate, bonded onto at least the first surface of the first substrate, the second substrate formed with a second through hole communicated with the first through hole;
- a communicating portion, at which the first through hole and the second through hole are connected; and
- a laminated film, including a coating layer comprised of a resin material, the laminated film provided on an inner wall face of the communicating portion.

In this configuration, the coating layer contained in the laminated film fixes the other layers contained the laminated film. Hence, the laminated film is prevented from cracking. There is no broken piece generated because of breaking of the laminated film.

Preferably, the first through hole, the second through hole and the communicating portion serve as a reservoir which is a liquid chamber common to the pressure generating chambers.

In this configuration, failure in ejection can be prevented from being caused by some nozzle orifice choked with liquid contaminated with a broken piece of the laminated film.

Here, it is preferable that the laminated film is covered with a protective film comprised of a resin material.

In this configuration, a broken piece can be surely prevented from being generated because the laminated film is fixed by the protective film. In addition, the ink ejecting property is improved because ink flows smoothly.

Preferably, the first through hole, the second through hole and the communicating portion are serve as a positioning member.

In this configuration, there is no broken piece generated from the laminated film in the positioning member.

Preferably, the laminated film is formed on an outer peripheral face of a bonding surface of the first substrate and the second substrate.

In this configuration, an alien substance such as a broken piece can be prevented from being generated in the outer circumferential edge portion of the second substrate.

Preferably, the coating layer is comprised of an adhesive agent bonding the first substrate and the second substrate.

In this configuration, the coating layer can be relatively easily formed while the other layers contained in the laminated film are surely fixed by the coating layer.

Preferably, the coating layer is comprised of at least one of an epoxy-based resin, an acrylic-based resin, a urethane-based resin and a silicone-based resin.

In this configuration, when the coating layer is made of a predetermined material, the other layers contained in the laminated film can be surely fixed by the coating layer.

Preferably, the laminated film includes a part of layers forming the piezoelectric elements.

In this configuration, the laminated film can be relatively easily formed while the stiffness of the laminated film is improved because the laminated layer is constituted by a plurality of layers.

Preferably, the first substrate is comprised of a silicon monocrystalline substrate. Here, the pressure chambers and the first through hole are formed by etching process. The upper electrode, the lower electrode and the piezoelectric layer are formed by at least one of the film-forming process or a lithographic process.

In this configuration, a liquid jetting head having high-density nozzle orifices can be mass-manufactured relatively easily.

Here, it is preferable that a layer forming the laminated film which is the closest to the first substrate is comprised of an etching-resistant material.

In this configuration, the first through hole can be relatively easily formed by etching.

According to the present invention, there is also provided a liquid jetting apparatus comprising the above liquid jetting head.

In this case, there can be achieved a liquid jetting apparatus in which ink ejecting property of the head is stabilized to improve reliability.

According to the present invention, there is also provided a method of manufacturing a liquid jetting head, comprising the steps of:

providing a first substrate, which defines a plurality of pressure generating chambers, the first substrate including a vibration plate which forms a first surface of the first substrate, and formed with a first through hole;

forming a plurality of piezoelectric elements on the vibration plate so as to associate with one of the pressure generating chambers, each piezoelectric element comprised of an upper electrode, a lower electrode and a piezoelectric layer provided between the upper electrode and the lower electrode;

providing a second substrate formed with a second through hole;

bonding the second substrate onto the first surface of the first substrate with an adhesive agent, while forming a coating layer comprised of a resin material on an inner wall face of a region at which the first through hole and the second through hole are to be connected; and forming a communicating portion at which the first through hole and the second through hole are connected.

In this configuration, the communicating portion is formed after the coating layer is formed. Hence, the inner wall portion of the communicating portion can be fixed by the coating layer to thereby prevent an alien substance such as a broken piece from being generated.

Preferably, the adhesive agent is extended so as to protruded from the inner wall face to form the coating layer.

In this configuration, the coating layer can be relatively easily formed, so that the manufacturing process can be simplified.

Preferably, the communicating portion is formed by a mechanical processing or a laser processing.

In this configuration, the communicating portion can be relatively easily formed.

Preferably, the manufacturing method further comprises the step of bonding a nozzle plate on a second surface of the first substrate opposing to the first surface, the nozzle plate formed with a plurality of nozzle orifices each communicated with one of the pressure generating chambers. Here, the bonding step of the nozzle plate is performed before the forming step of the communicating portion.

In this configuration, the stiffness of the first substrate is improved by the nozzle plate. Hence, the channel forming substrate can be prevented from cracking when the communicating portion is formed.

Preferably, the steps are performed with respect to a wafer in which a plurality of first substrates are integrally formed. The respective first substrates are divided after the forming step of the communicating portion.

Here, it is preferable that the coating layer is formed on an outer peripheral face of a bonding surface of each first substrate and an associated second substrate.

In this configuration, the wafer is divided along respective coating layers so that divided surfaces become relatively flat. Hence, an alien substance such as a broken piece can be restrained from being generated.

Preferably, the pressure chambers and the first through hole are formed by etching a silicon monocrystalline substrate. The upper electrode, the lower electrode and the piezoelectric layer are formed by at least one of the film-forming process or a lithographic process.

Preferably, the manufacturing method further comprises the step of covering the coating layer with a protective layer comprised of a resin material.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the invention will be described below with reference to the accompanying drawings.

Figure 1:
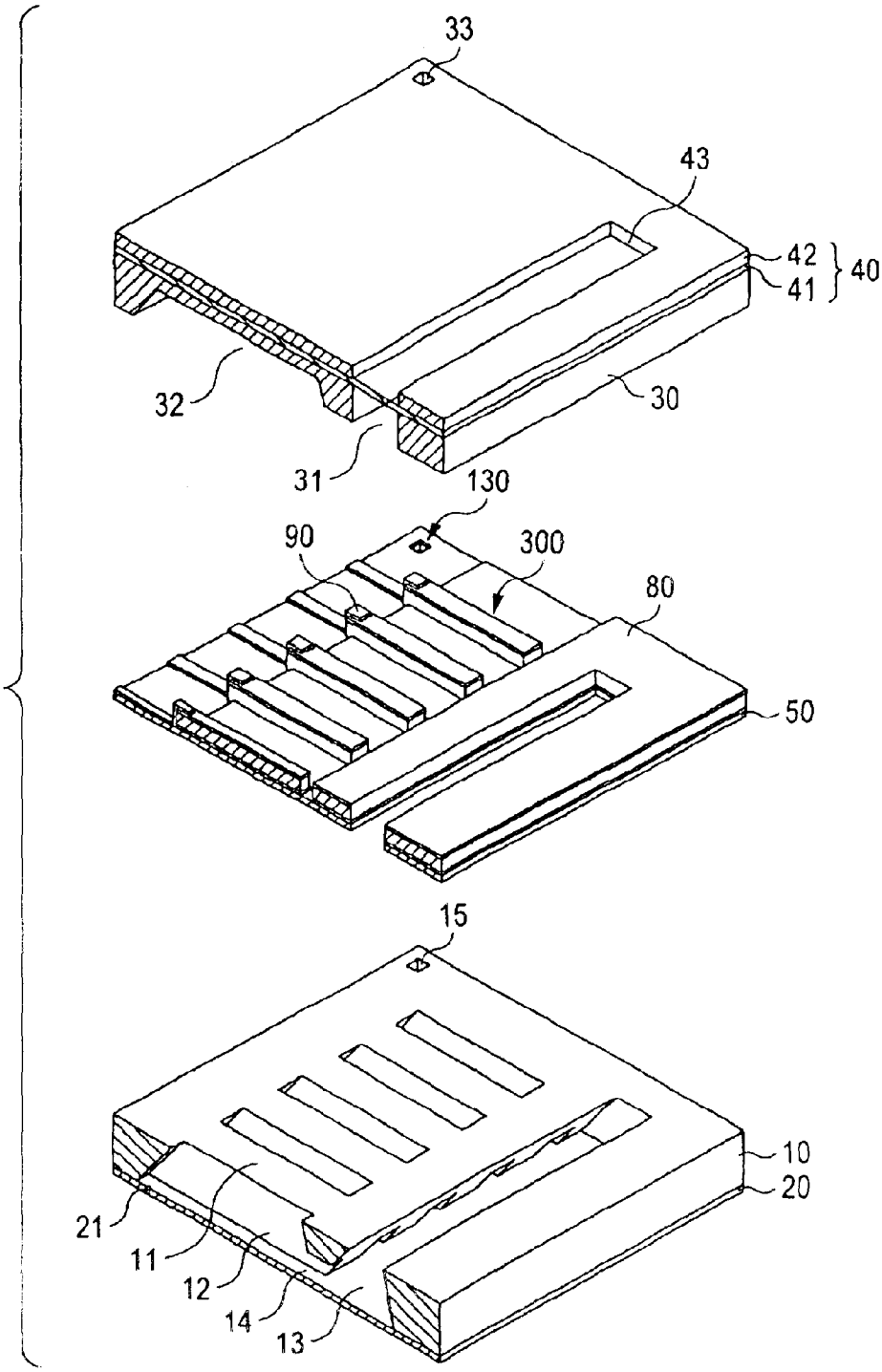
FIG. 1 is an exploded perspective view of an ink jet recording head according to a first embodiment of the invention.
Figure 2A:
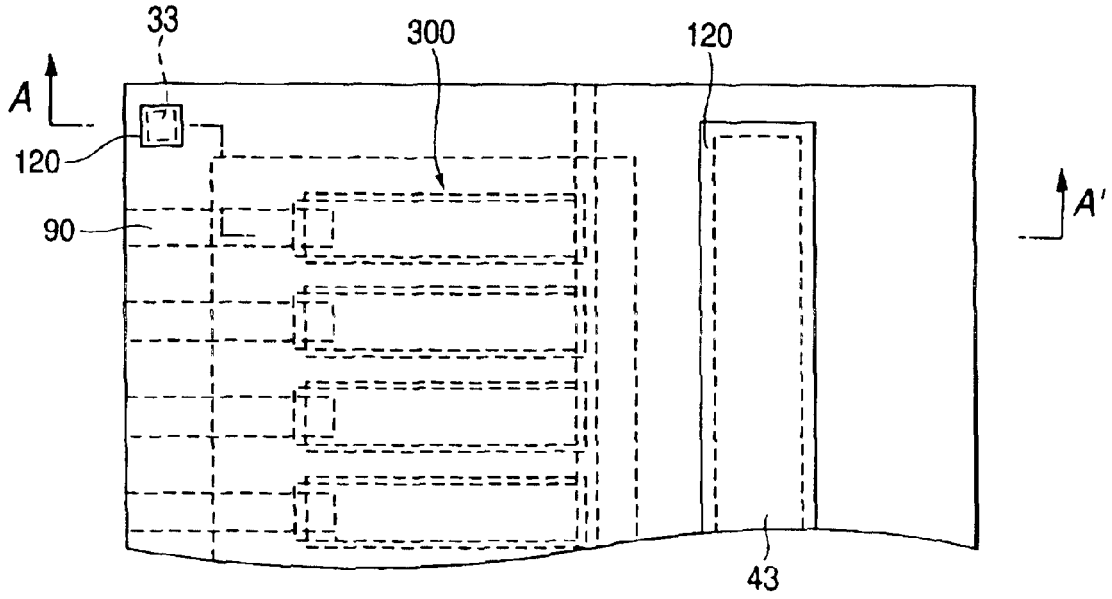
FIGS. 2A and 2B are a plan view and a sectional view of the ink jet recording head according to the first embodiment of the invention.
Figure 2B:
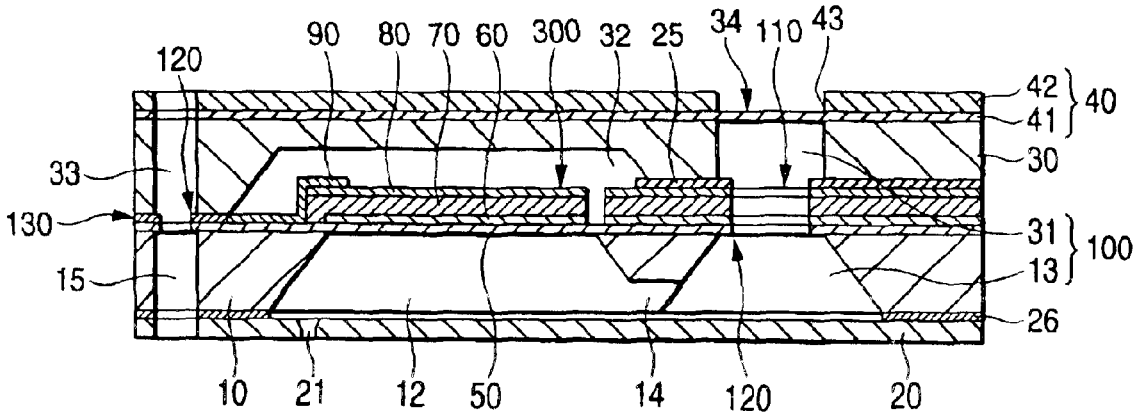

As shown in FIGS. 1, 2A and 2B, according to a first embodiment of the invention, a channel forming substrate 10 is constituted by a monocrystalline silicon substrate oriented to a (110) plane. As the channel forming substrate 10, it is preferable to use a substrate having generally a thickness of about 150 μm to about 300 μm, particularly a thickness of about 180 μm to about 280 μm, more particularly a thickness of about 220 μm. This is because pressure generating chambers can be arranged densely while partition walls between adjacent pressure generating chambers are kept stiff.

One of opposite surfaces of the channel forming substrate 10 is provided as an open surface. An elastic film 50 of silicon dioxide formed by thermal oxidation in advance and having a thickness of 1 μm to 2 μm is formed on the other surface side of the channel forming substrate 10.

On the other hand, the open surface of the channel forming substrate 10 is processed by anisotropic etching of the monocrystalline silicon substrate. As a result, pressure generating chambers 12 separated by a plurality of partition walls are arranged widthwise side by side in the open surface of the channel forming substrate 10. A communicating portion 13 is formed in the outside of one longitudinal end of the pressure generating chambers 12 so that the communicating portion 13 can communicate with a reservoir portion 31 of a reservoir forming substrate 30 (which will be described later) to thereby form a part of a reservoir 100 which serves as an ink chamber common to all the pressure generating chambers 12. The communicating portion 13 communicates with one longitudinal end portion of each of the pressure generating chambers 12 through corresponding one of ink supply passages 14.

A positioning hole 15 is formed in a neighbor of an end portion of the channel forming substrate 10 opposite to the communicating portion 13 so that the channel forming substrate 10 can be positioned when assembled with the reservoir forming substrate 30 (which will be described later), etc.

The anisotropic etching is performed by using difference in etching rate of the monocrystalline silicon substrate. For example, in this embodiment, the anisotropic etching is performed by using the following property. That is, when the monocrystalline silicon substrate is immersed in an alkaline solution of KOH or the like, the monocrystalline silicon substrate is eroded gradually. As a result, first (111) planes perpendicular to the (110) plane and second (111) planes at an angle of about 70 degrees to the first (111) planes and at an angle of about 35 degrees to the (110) plane appear, so that the etching rate of the (111) planes is about 1/180 as low as that of the (110) plane. By the anisotropic etching, accurate processing can be performed on the basis of formation of a depth shaped like a parallelogram constituted by two first (111) planes and two oblique second (111) planes. Hence, the pressure generating chambers 12 can be arranged densely.

In this embodiment, long sides of each of the pressure generating chambers 12 are constituted by the first (111) planes, and short sides thereof are constituted by the second (111) planes. The pressure generating chambers 12 are formed in the channel forming substrate 10 when the channel forming substrate 10 is etched in such a manner that erosion almost passes through the channel forming substrate 10 and reaches the elastic film 10. Here, the quantity of the elastic film 50 eroded by the alkaline solution used for etching the monocrystalline silicon substrate is very small. The ink supply passages 14 communicating with the one-side ends of the pressure generating chambers 12 respectively are formed so as to be shallower than the pressure generating chambers 12 to thereby keep the flow resistance of ink flowing into the pressure generating chambers 12 constant. That is, the ink supply passages 14 are formed by etching the monocrystalline silicon substrate halfway in a thickness direction (half-etching). Incidentally, the half-etching is performed on the basis of adjustment of etching time.

A nozzle plate 20 is fixed on the open surface side of the channel forming substrate 10 through an adhesive agent, a thermal welding film, or the like. The nozzle plate 20 has nozzle orifices 21 which are formed to communicate with the pressure generating chambers 12 on a side opposite to the ink supply passage 14 side. Incidentally, the nozzle plate 20 is made of glass ceramics, rustless steel, or the like, for example, having a thickness of 0.1 mm to 1 mm and, for example, having a linear expansion coefficient of 2.5 to 4.5 [$\times 10^{-6}$/° C.] at 300° C. or lower. The nozzle plate 20 serves also as a reinforcing plate for entirely covering one surface of the channel forming substrate 10 with its one surface to thereby protect the monocrystalline silicon substrate from external impact or force.

On the other hand, a lower electrode film 60, for example, about 0.2 μm thick, a piezoelectric film 70, for example, about 1 μm thick, and an upper electrode film 80, for example, 0.1 μm thick, are laminated on the elastic film 50 of the channel forming substrate 10 on a side opposite to the open surface side by a process which will be described later. In this manner, piezoelectric elements 300 are formed. The term "piezoelectric element 300" used herein means a portion containing the lower electrode film 60, the piezoelectric film 70, and the upper electrode film 80. Generally, one of the electrodes contained in each of the piezoelectric elements 300 is provided as a common electrode, and the other electrode and the piezoelectric film 70 are formed by patterning in association with each of the pressure generating chambers 12. A portion which is constituted by the electrode and the piezoelectric film obtained by patterning and which is piezoelectrically distorted when a voltage is applied between the two electrodes is called "piezoelectric active portion" here. Although this embodiment has shown the case where the lower electrode film 60 is used as an electrode common to all the piezoelectric elements 300 and the upper electrode film 80 is used as electrodes individual to the piezoelectric elements 300, there is no hindrance even in the case where the order is reversed for the sake of convenience of a drive circuit or wiring. In either case, a piezoelectric active portion is formed in association with each of the pressure generating chambers.

A lead electrode 90, for example, of gold (Au) is extended from a neighbor of a longitudinal end portion of the upper electrode film 80 in each of the piezoelectric elements 300 to a neighbor of an end portion of the channel forming substrate 10. External wiring (not shown) for driving the piezoelectric elements 300 is electrically connected to a neighbor of an end portion of the lead electrode 90.

A reservoir forming substrate 30 having a reservoir portion 31 forming at least one part of a reservoir 100 is bonded onto the piezoelectric element 300 side of the channel forming substrate 10 by an adhesive agent 25.

The reservoir portion 31 is formed in a widthwise direction of the pressure generating chambers 12 so as to pass through the reservoir forming substrate 30 in a thickness direction thereof. As described above, the reservoir portion 31 communicates with the communicating portion 13 of the channel forming substrate 10 to thereby form the reservoir 100 which is an ink chamber common to all the pressure generating chambers 12.

Figure 3:
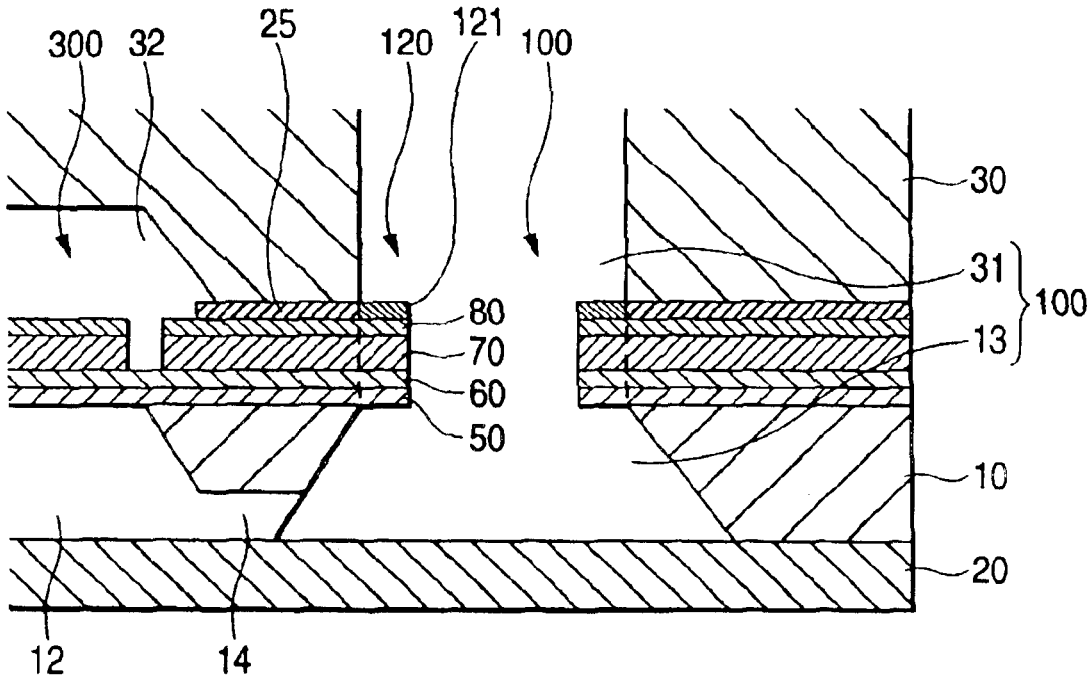
FIG. 3 is an enlarged sectional view showing an essential part of the ink jet recording head according to the first embodiment of the invention.

As shown in FIG. 3, the reservoir portion 31 of the reservoir forming substrate 30 and the communicating portion 13 of the channel forming substrate 10 communicate with each other through a communicating portion 110. A laminated film 120 containing a coating layer 121 made of a resin material is provided on an inner circumferential edge portion of the communicating portion 110. In this embodiment, the laminated film 120 contains the coating layer 121, the elastic film 50, the lower electrode film 60, the piezoelectric film 70, and the upper electrode film 80.

The coating layer 121 contained in the laminated film 120 is made of a resin material such an epoxy-based resin, an acrylic-based resin, a urethane-based resin or a silicone-based resin. The coating layer 121 is preferably formed to have a thickness of about 1 $\mu$m to about 10 $\mu$m and a width of about 10 $\mu$m to about 100 $\mu$m.

In this embodiment, the coating layer 121 is comprised of the adhesive agent 25 used for bonding the channel forming substrate 10 and the reservoir forming substrate 30 to each other. That is, when the channel forming substrate 10 and the reservoir forming substrate 30 are bonded to each other, the adhesive agent 25 is protruded into the reservoir portion 31 to thereby form the coating layer 121.

Because the laminated film 120 provided on the inner circumferential edge portion of the communicating portion 110 contains the coating layer 121 as described above, the laminated film 120 is not peeled off at the time of execution of printing so that ink is not contaminated with any broken piece. Hence, failure in ejection of ink drops can be prevented from being caused by some nozzle orifice choked with such a broken piece.

Although this embodiment has shown the case where the laminated film 120 contains the coating layer 121, the elastic film 50 and respective layers constituting each piezoelectric element 300, the configuration of the other layers than the coating layer 121 is not particularly limited if the laminated film 120 contains at least the coating layer 121. For example, the laminated film may be constituted by a combination of a coating layer and an elastic film or by a combination of a coating layer and at least one of layers constituting each piezoelectric element. It is a matter of course that the coating layer may be formed as a layer provided separately from the piezoelectric element.

On the other hand, piezoelectric element chambers 32 are provided in a region of the reservoir forming substrate 30 opposite to the piezoelectric elements 300 so as to define hermetically sealed spaces. Each piezoelectric element 300 is accommodated in one of the spaces such that the piezoelectric motion thereof is not disturbed.

A positioning hole 33 is provided in the reservoir forming substrate 30 so that the reservoir forming substrate 30 can be positioned by the positioning hole 33 when the reservoir forming substrate 30 is assembled with the channel forming substrate 10. The positioning hole 33 communicates with the positioning hole 15 provided in the channel forming substrate 10 through a communicating portion 130.

The laminated film 120 containing the coating layer 121 made of a resin material is also provided in a region corresponding to the inner circumferential edge portion of the communicating portion 130 in the same manner as the communicating portion 110. In this embodiment, the laminated film 120 of the communicating portion 130 is constituted by a combination of the coating layer 121 and the elastic film 50. Because the elastic film 50 is fixed by the coating layer 121, there is no alien substance generated because of peeling of the elastic film 50.

Incidentally, a compliance substrate 40 constituted by a combination of a sealing film 41 and a fixing plate 42 is joined to the reservoir forming substrate 30. The sealing film 41 is made of a flexible material low in stiffness, such as a 6 $\mu$m-thick polyphenylene sulfide (PPS) film. One surface of the reservoir portion 31 is sealed with the sealing film 41. The fixing plate 42 is made of a rigid material such as a metal. For example, the fixing plate 42 is made of 30 $\mu$m-thick stainless steel (SUS), or the like. A region of the fixing plate 42 opposite to the reservoir 100 is entirely removed in a thickness direction so as to be opened. Hence, one surface of the reservoir 100 in this region is sealed with only the flexible sealing film 41 to thereby form a flexible portion 34 which can be deformed by the change of internal pressure.

In the ink jet recording head configured according to this embodiment, the inside ranging from the reservoir 100 to the nozzle orifices 21 is filled with ink taken in from an external ink supply unit (not shown), and a drive voltage is then applied between the lower electrode film 60 and the upper electrode film 80 associated with the subject pressure generating chamber 12, on the basis of a recording signal given from an external drive circuit (not shown) to thereby flexibly deform the elastic film 50, the lower electrode film 60 and the piezoelectric film 70. As a result, pressure in the subject pressure generating chamber 12 becomes high, so that ink drops are ejected from the nozzle orifices 21.

A process for manufacturing the ink jet recording head according to this embodiment will be described below with reference to FIGS. 4A to 4D, FIGS. 5A to 5C, FIGS. 6A and 6B and FIGS. 7A and 7B.

Figure 4A:
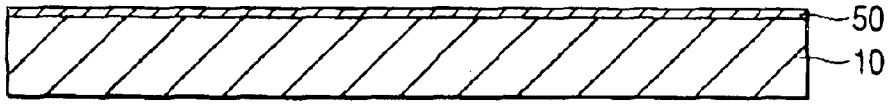
FIGS. 4A to 4D are sectional views showing a process for manufacturing the ink jet recording head according to the first embodiment of the invention.

First, as shown in FIG. 4A, an elastic film 50 is formed on one surface of a channel forming substrate 10. Specifically, for example, a monocrystalline silicon substrate of 220 $\mu$m thick as a channel forming substrate 10 is thermally oxidized in a diffusion furnace at about 1,100° C. to thereby form an elastic film 50 of silicon oxide on one surface of the channel forming substrate 10.

Figure 4B:
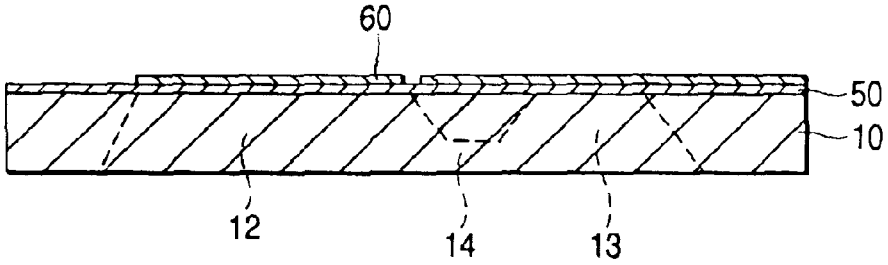

Then, as shown in FIG. 4B, a lower electrode film 60 is formed on the whole surface of the elastic film 50 by sputtering and then patterned to thereby form an entire pattern. Platinum (Pt) or the like is preferred as the material of the lower electrode film 60. This is because the piezoelectric film 70 which will be described later and which is formed by a sputtering method or a sol-gel method needs to be crystallized by baking at a temperature of 600° C. to 1,000° C. under an atmosphere of air or oxygen after film formation. That is, the material of the lower electrode film 60 must be kept electrically conductive under such a high-temperature oxidative atmosphere. Particularly when lead zirconate titanate (PZT) is used as the material of the piezoelectric film 70, it is preferable that variation in the conductivity due to diffusion of lead oxide is less. For these reasons, platinum is preferred.

Figure 4C:
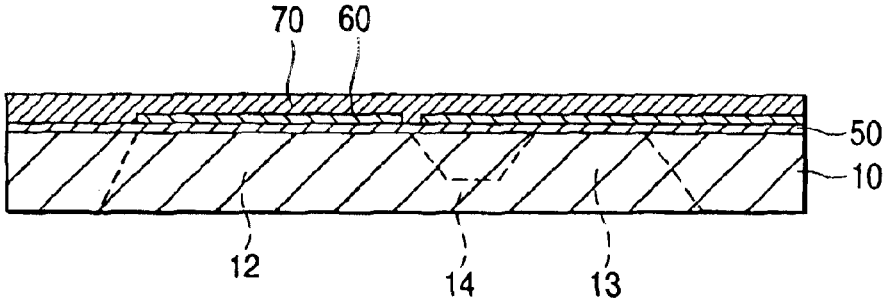

Then, as shown in FIG. 4C, a piezoelectric film 70 is formed. It is preferable that the piezoelectric film 70 has crystal oriented. For example, in this embodiment, the piezoelectric film 70 having crystal oriented is formed by a so-called sol-gel method in which sol of a metal organic compound dissolved and dispersed into a catalyst is applied and dried to be gelated and further baked at a high temperature to thereby obtain a piezoelectric film 70 of metal oxide. A lead zirconate titanate-based material is preferably used as the material of the piezoelectric film 70 for such an ink jet recording head. Incidentally, the film-forming method of the piezoelectric film 70 is not particularly limited. For example, the piezoelectric film 70 may be formed by a sputtering method.

Alternatively, there may be used a technique in which crystal is grown at a low temperature by a high-pressure processing method in an alkaline aqueous solution after a precursor film of lead zirconate utanate is formed by a sol-gel method or a sputtering method.

In any case, the thus formed piezoelectric film 70 is different from a bulk piezoelectric body in that crystal is preferentially oriented in the piezoelectric film 70. In addition, in this embodiment, crystal in the piezoelectric film 70 is formed columnarly. Incidentally, the term "preferential orientation" means a state in which the direction of crystal orientation is not disordered so that specific crystal faces are substantially oriented to a predetermined direction. The term "thin film of crystal formed columnarly" means a state in which a thin film is formed in such a manner that substantially columnar crystal gathers in a planar direction while the central axis of crystal substantially coincides with a thickness direction. It is a matter of course that the piezoelectric film 70 may be a thin film formed from granular crystals preferentially oriented. Incidentally, the thickness of the piezoelectric film manufactured by this thin-film process is generally in a range of from 0.2 $\mu$m to 5 $\mu$m.

Figure 4D:
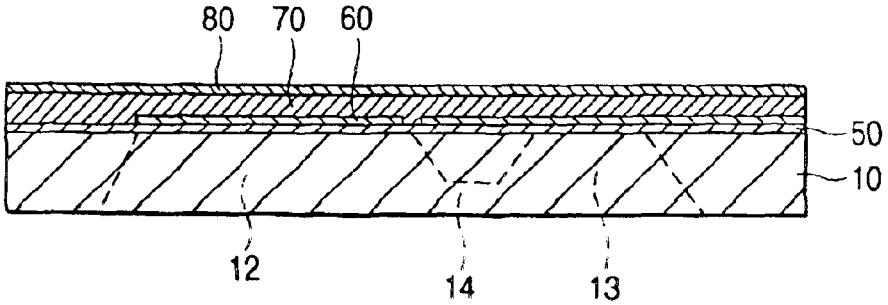

Then, as shown in FIG. 4D, an upper electrode film 80 is formed. Any material can be used as the material of the upper electrode film 80 if the material has high conductivity. Examples of the material of the upper electrode film 80 include: various metals such as aluminum, gold, nickel, and platinum; and conductive oxides. In this embodiment, the upper electrode film 80 is made of platinum by sputtering.

Figure 5A:
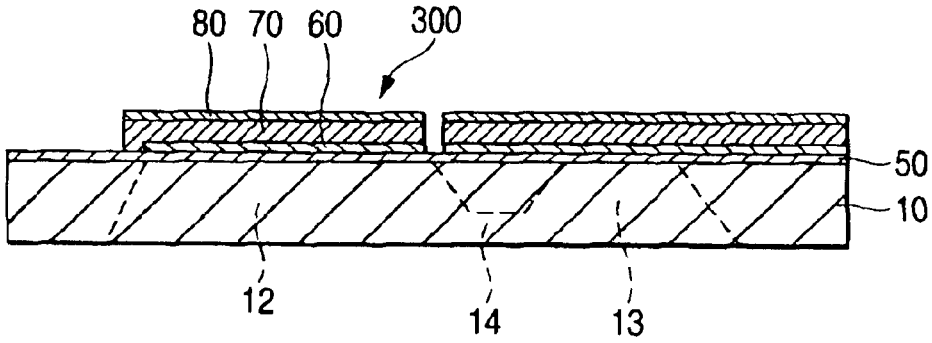
FIGS. 5A to 5C are sectional views showing a process for manufacturing the ink jet recording head according to the first embodiment of the invention.

Then, as shown in FIG. 5A, the piezoelectric film 70 and the upper electrode film 80 are selectively patterned to thereby form piezoelectric elements 300 in regions opposite to the pressure generating chambers 12 respectively. In this embodiment, respective layers constituting a piezoelectric element 300 are also left in a region corresponding to the communicating portion 110. Incidentally, the respective layers in the region corresponding to the communicating portion 110 are patterned so as to be discontinuous to the piezoelectric elements 300.

Figure 5B:
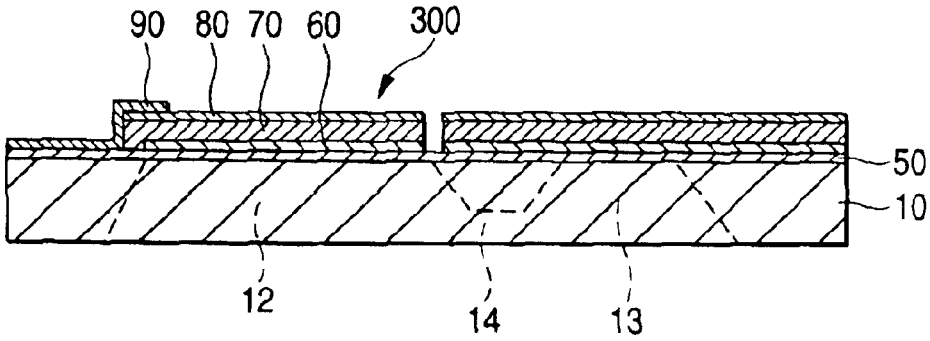

Then, as shown in FIG. 5B, lead electrodes 90 are formed. Specifically, the lead electrodes 90, for example, of gold (Au) is formed on the whole surface of the channel forming substrate 10 and patterned in association with the piezoelectric elements 300.

Figure 5C:
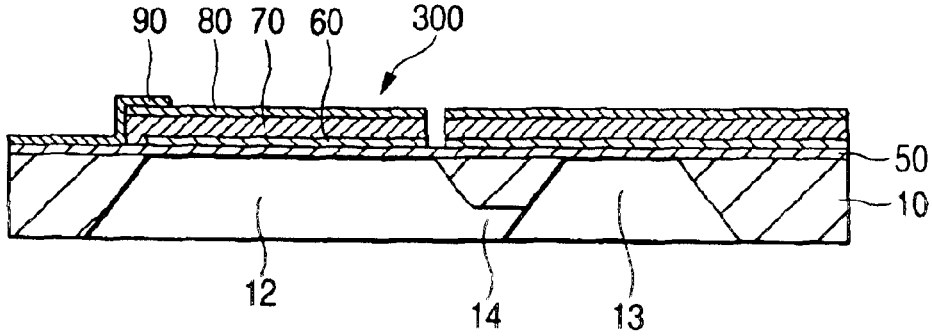

The film-forming process has been described above. After film formation is performed thus, as shown in FIG. 5C, the monocrystalline silicon substrate is anisotropically etched with the alkaline solution to thereby form the pressure generating chambers 12, the ink supply passages 14 and the communicating portion 13 at once.

In this embodiment, the lowermost layer in the laminated film 120, that is, the layer nearest to the channel forming substrate 10 is the elastic film 50. Because the elastic film 50 is made of an etching-resistant material, the communicating portion 13 piercing the channel forming substrate 10 can be easily formed when the channel forming substrate 10 is etched so that the etched portion reaches the elastic film 50.

Moreover, because the elastic film 50 and respective layers constituting a piezoelectric element 300 are left in the region corresponding to the communicating portion 13, there is no alkaline solution flowing in the piezoelectric element 300 side at the time of etching. Hence, the piezoelectric elements 300 can be prevented from being destroyed.

Figure 6A:
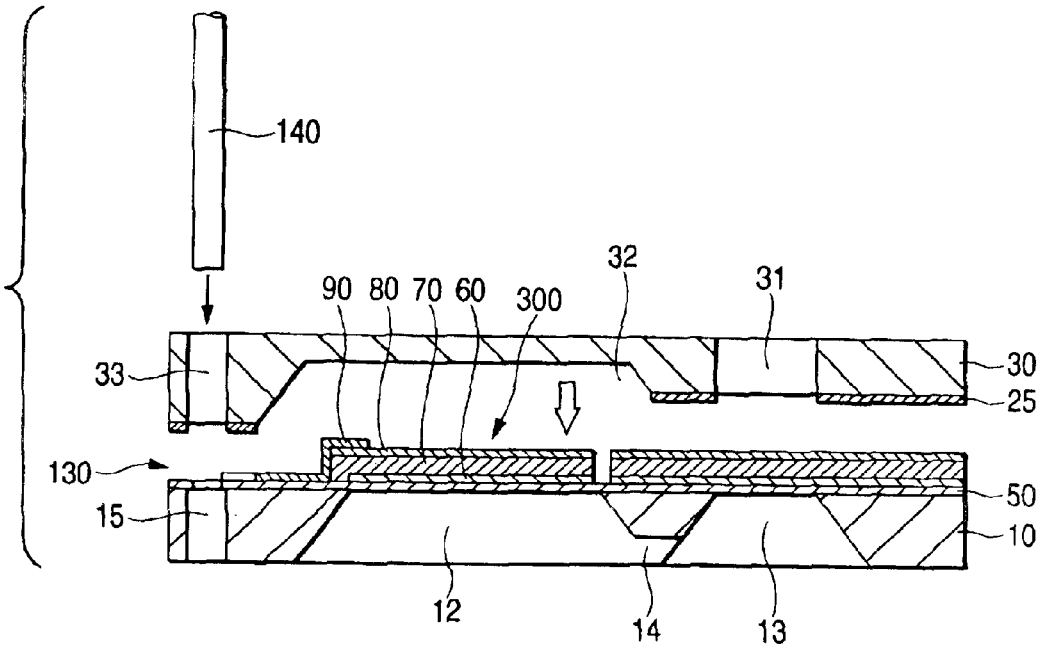
FIGS. 6A and 6B are sectional views showing a process for manufacturing the ink jet recording head according to the first embodiment of the invention.

Then, as shown in FIG. 6A, the channel forming substrate 10 and the reservoir forming substrate 30 are bonded to each other by an adhesive agent 25. Specifically, after the communicating portion 130 is formed by mechanically removal of the elastic film 50 blocking the positioning hole 15 of the channel forming substrate 10, a positioning member 140 is inserted both in the positioning hole 15 of the channel forming substrate 10 and in the positioning hole 33 of the reservoir forming substrate 30 to thereby position the channel forming substrate 10 and the reservoir forming substrate 30 in predetermined positions. In this condition, the channel forming substrate 10 and the reservoir forming substrate 30 are bonded to each other.

Figure 6B:
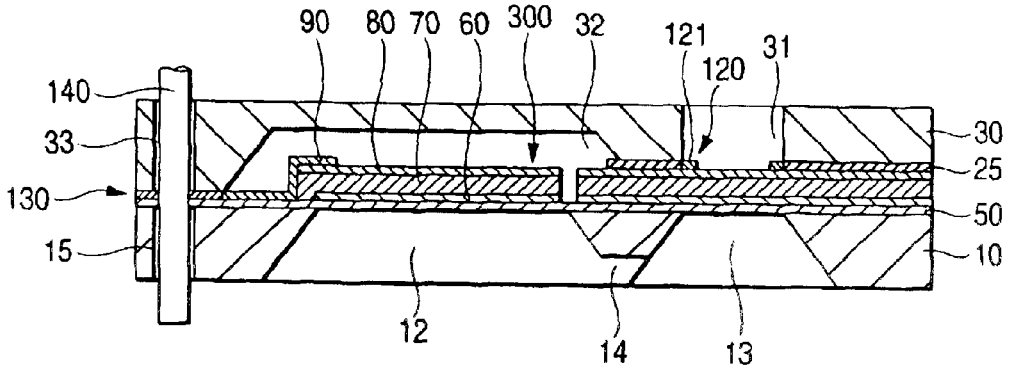

On this occasion, as shown in FIG. 6B, the adhesive agent 25 for bonding the channel forming substrate 10 and the reservoir forming substrate 30 to each other is protruded into the reservoir portion 31 of the reservoir forming substrate 30 to thereby form the coating layer 121.

The adhesive agent 25 is further protruded into the positioning hole 33 as well as the reservoir portion 31 to thereby form the coating layer 121. As a result, the laminated film 120 constituted by a combination of the coating layer 121 and the elastic film 50 is formed in a region corresponding to the inner circumferential edge portion of the communicating portion 130. Hence, the elastic film 50 in the communicating portion 130 is fixed by the coating layer 121 to be integrated with the coating layer 121, so that an alien substance such as a broken piece can be prevented from being generated in an assembling process after that.

The coating layer 121 is not limited to a layer made of the adhesive agent 25 used for bonding the channel forming substrate 10 and the reservoir forming substrate 30 to each other. It is a matter of course that the coating layer 121 may be provided separately from the adhesive agent 25.

Figure 7A:
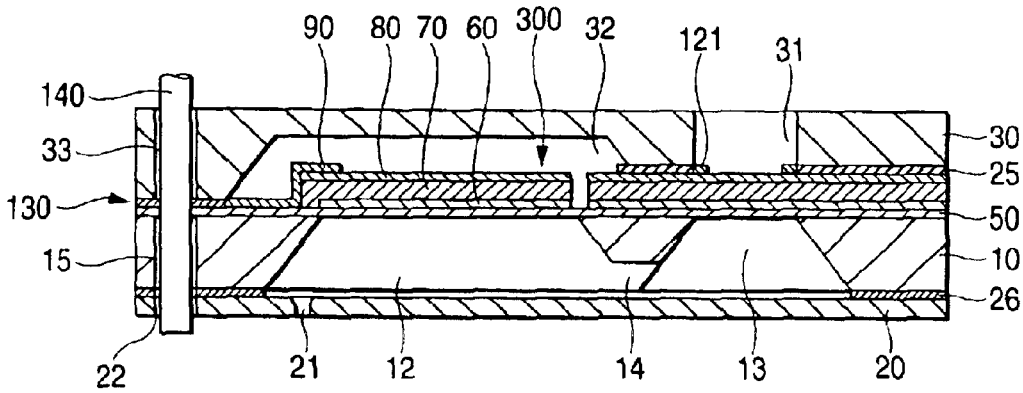
FIGS. 7A and 7B are sectional views showing a process for manufacturing the ink jet recording head according to the first embodiment of the invention.

Then, as shown in FIG. 7A, the positioning member 140 is inserted in the positioning hole 22 of the nozzle plate 20 to thereby position the nozzle plate 20 in a predetermined position. In this condition, the nozzle plate 20 is bonded onto the pressure generating chamber 12 side of the channel forming substrate 10 by an adhesive agent 26.

Figure 7B:
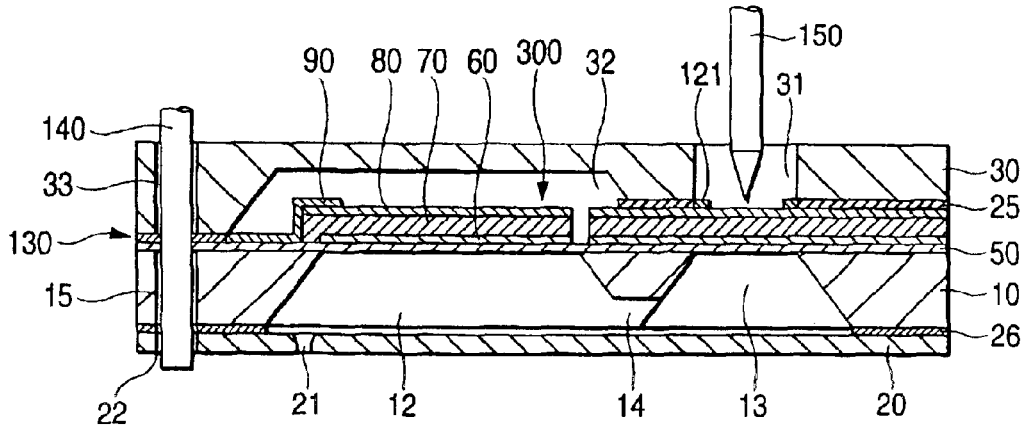

Then, as shown in FIG. 7B, the communicating portion 110 is formed so that the reservoir portion 31 and the communicating portion 13 can communicate with each other. That is, force is mechanically applied to the respective layers of the elastic film 50, the lower electrode film 60, the piezoelectric film 70 and the upper electrode film 80, for example, by a needle-like perforating jig 150 from the reservoir portion 31 side to thereby destroy and remove the respective layers. On this occasion, because the respective layers in a portion where the coating layer 121 is provided are fixed by the coating layer 121, the respective layers inclusive of the elastic film 50 and so on are removed along the coating layer 121. In this manner, the coating layer 121 and the laminated film 120 constituted by a combination of the elastic film 50, the lower electrode film 60, the piezoelectric film 70 and the upper electrode film 80 are formed in the inner circumferential edge portion of the communicating portion 110 (see FIG. 3).

In this manner, because the communicating portion 110 is formed after the coating layer 121 is formed, the elastic film 50, the lower electrode film 60, the piezoelectric film 70 and the upper electrode film 80 are partly removed along the coating layer 121 so that the fracture surface becomes relatively flat. That is, because the inner surface of the communicating portion 110 becomes relatively flat, a flow of ink in the reservoir 100 is not hindered so that stable ink ejecting property is obtained. In addition, because the laminated film 120 remaining in the inner circumferential edge portion of the communicating portion 110 is fixed by the coating layer 121, there is no alien substance generated because of cracking of the laminated film 120 at the time of printing or the like. Hence, failure in election can be prevented from being caused by choking of some nozzle orifice with the alien substance.

Incidentally, though not shown, the compliance substrate 40 is then joined onto the reservoir forming substrate 30 to thereby form an ink jet recording head according to this embodiment.

In practice, a large number of chips are formed on one wafer at once by such a series of steps. After the process is completed, the wafer is divided by the channel forming substrate 10 of the chip size shown in FIG. 1.

Hence, when the channel forming substrate 10 and the reservoir forming substrate 30 are bonded to each other by the adhesive agent 25, the adhesive agent 25 may be protruded over the outer circumferential edge portion of the reservoir forming substrate 30 so that the coating layer can be also formed on the outer circumferential edge portion of the reservoir forming substrate 30. As a result, the wafer can be relatively clearly divided by the channel forming substrate 10, and an alien substance such as a broken piece can be prevented from being manufactured at that time. In this case, after the wafer is divided by the channel forming substrate 10, a laminated film having a coating layer remains in the outer circumferential edge portion of each reservoir forming substrate 30.

Figure 8:
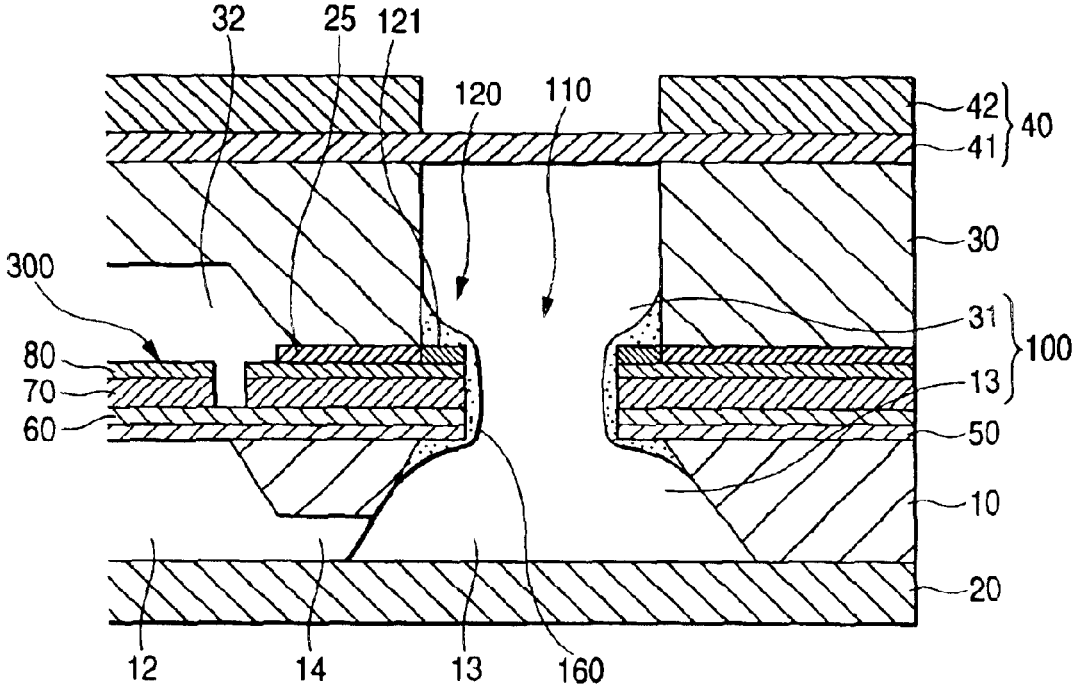
FIG. 8 is an enlarged sectional view showing essential part of an ink jet recording head according to a second embodiment of the invention.

In a second embodiment as shown in FIG. 8, an alien substance such as a broken piece of the laminated film 120 is more surely prevented from being manufactured. This embodiment is the same as the first embodiment except that the laminated film 120 of the communicating portion 110 is covered with a protective film 160 made of a resin material.

Hence, the nozzle orifices are prevented from being choked with ink contaminated with an alien substance manufactured from the laminated film 120. In addition, because a flow of ink in the reservoir 100 is smoothened by the protective film 160, the ink ejection property can be improved.

Although embodiments of the invention have been described above, the basic configuration of the ink jet recording head is not limited thereto.

For example, although the embodiments have shown the case where the invention is applied to a thin-film type ink jet recording head which can be manufactured by application of a film-forming and lithography process, it is a matter of course that the invention is not limited thereto, but may be applied to ink jet recording heads having various kinds of structures such as an ink jet recording head of the type in which substrates are laminated to form pressure generating chambers, an ink jet recording head of the type in which a piezoelectric layer is formed by sticking of a green sheet, screen printing, or the like, and an ink jet recording head of the type in which a piezoelectric layer is formed by a crystal growth method such as a hydrothermal crystallization method.

As described above, the invention may be applied to ink jet recording heads having various kinds of structures without departing from the gist thereof.

Figure 9:
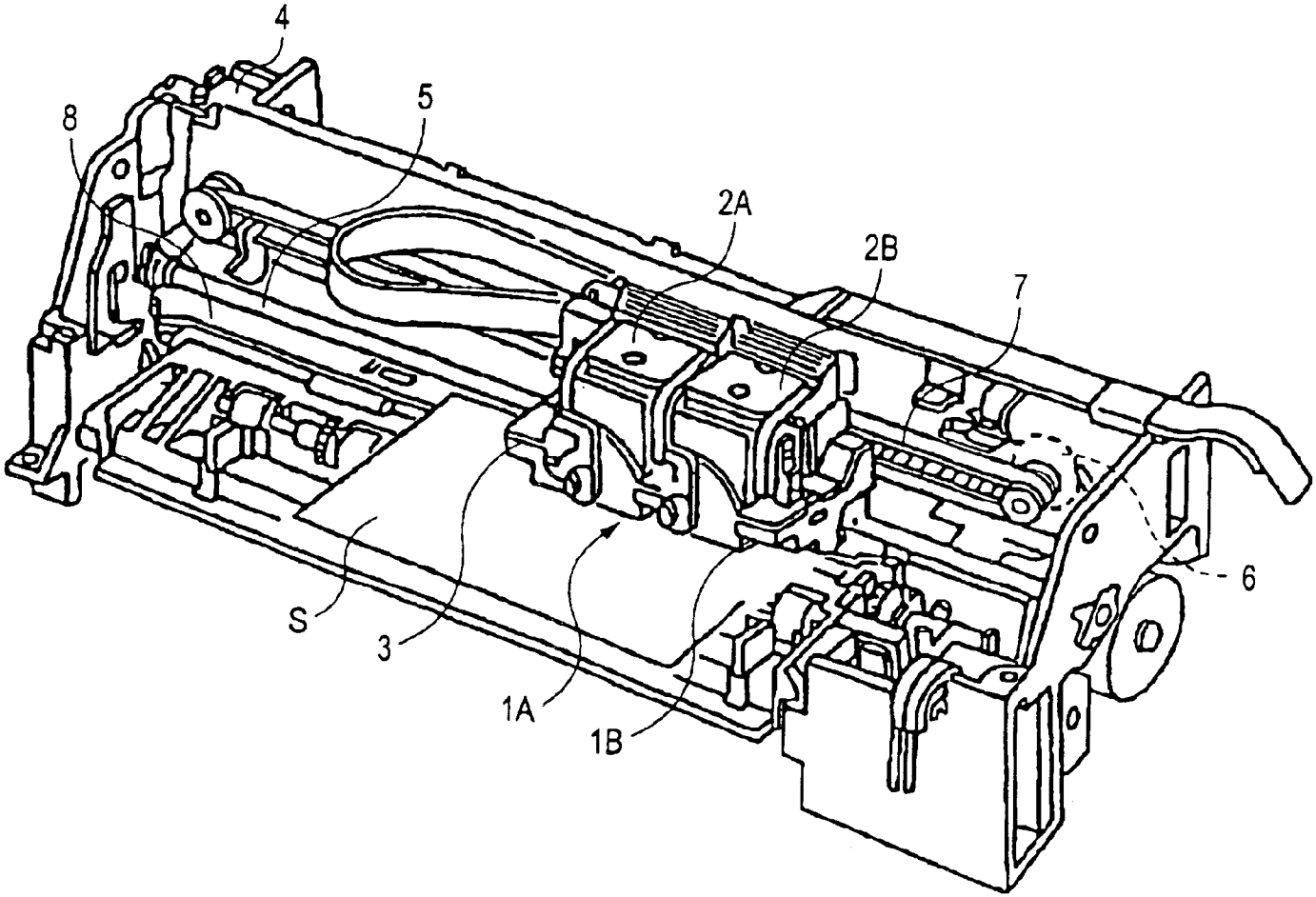
FIG. 9 is a schematic view of an ink jet recording apparatus according to an embodiment of the invention.

Further, the ink jet recording head according to any one of the embodiments is mounted in an ink jet recording apparatus while it forms a part of a recording head unit having an ink flow path communicating with an ink cartridge or the like. FIG. 9 is a schematic view showing an example of the ink jet recording apparatus.

As shown in FIG. 9, recording head units 1A and 1B having ink jet recording heads respectively are provided so that cartridges 2A and 2B constituting ink supply units can be detachably mounted on the recording head units 1A and 1B respectively. The recording head units 1A and 1B are mounted in a carriage 3. The carriage 3 is provided on a carriage shaft 5 attached to an apparatus body 4 so that the carriage 3 can move axially. For example, the recording head units 1A and 1B are provided for ejecting a black ink composition and a color ink composition respectively.

The drive force of a drive motor 6 is transmitted to the carriage 3 through a plurality of gears not shown and a timing belt 7 to thereby move the carriage 3 mounted with the recording head units 1A and 1B along the carriage shaft 5. On the other hand, a platen 8 is provided on the apparatus body 4 so as to extend along the carriage shaft 5. The platen 8 can be rotated by the drive force of a paper feed motor (not shown), so that a recording sheet S which is a recording medium such as paper fed by a paper feed roller or the like can be carried on the platen 8.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, in the above embodiments, the description was made with reference to the ink jet recording apparatus, which is a kind of the liquid jetting apparatus. However, the present invention can be applied to other kind of liquid jetting apparatus. For instance, an electrode member ejection head for an electrode forming apparatus, an organic substance jetting head for a bio-chip manufacturing apparatus, or the like.

What is claimed is:

1. A method of manufacturing an liquid jetting head, comprising the steps of:

providing a first substrate, which defines a plurality of pressure generating chambers, the first substrate including a vibration plate which forms a first surface of the first substrate, and formed with a first through hole;

forming a plurality of piezoelectric elements on the vibration plate so as to associate with one of the pressure generating chambers, each piezoelectric element comprised of an upper electrode, a lower electrode and a piezoelectric layer provided between the upper electrode and the lower electrode;

providing a second substrate formed with a second through hole;

bonding the second substrate onto the first surface of the first substrate with an adhesive agent, while forming a coating layer comprised of a resin material on an inner wall face of a region at which the first through hole and the second through hole are to be connected; and forming a communicating portion at which the first through hole and the second through hole are connected.

2. The manufacturing method as set forth in claim 1, wherein the adhesive agent is extended so as to protruded from the inner wall face to form the coating layer.

3. The manufacturing method as set forth in claim 1, wherein the communicating portion is formed by a mechanical processing.

4. The manufacturing method as set forth in claim 1, wherein the communicating portion is formed by a laser processing.

5. The manufacturing method as set forth in claim 1, further comprising the step of bonding a nozzle plate on a second surface of the first substrate opposing to the first surface, the nozzle plate formed with a plurality of nozzle orifices each communicated with one of the pressure generating chambers, wherein the bonding step of the nozzle plate is performed before the forming step of the communicating portion.

6. The manufacturing method as set forth in claim 1, wherein:

the steps are performed with respect to a wafer in which a plurality of first substrates are integrally formed; and the respective first substrates are divided after the forming step of the communicating portion.

7. The manufacturing method as set forth in claim 6, wherein the coating layer is formed on an outer peripheral face of a bonding surface of each first substrate and an associated second substrate.

8. The manufacturing method as set forth in claim 1, wherein:

the pressure chambers and the first through hole are formed by etching a silicon monocrystalline substrate; and the upper electrode, the lower electrode and the piezoelectric layer are formed by at least or a lithographic process.

9. The manufacturing method as set forth in claim 1, further comprising the step of covering the coating layer with a protective layer comprised of a resin material.

* * * * *